US009688513B2

(12) United States Patent
Zhu et al.

(10) Patent No.: US 9,688,513 B2
(45) Date of Patent: Jun. 27, 2017

(54) SPECIFIC ELEVATOR ANTI-FALL BUFFER BASED ON FLEXIBLE GUIDANCE

(71) Applicants: DONGNAN ELEVATOR CO., LTD., Jiangsu (CN); CHINA UNIVERSITY OF MINING AND TECHNOLOGY, Jiangsu (CN)

(72) Inventors: Zhencai Zhu, Jiangsu (CN); Jiancong Qin, Jiangsu (CN); Guohua Cao, Jiangsu (CN); Guangfeng Mao, Jiangsu (CN); Wei Li, Jiangsu (CN); Gongbo Zhou, Jiangsu (CN); Beibei Fu, Jiangsu (CN); Hongbin Fei, Jiangsu (CN); Yiping Ma, Jiangsu (CN); Jianrong Yang, Jiangsu (CN)

(73) Assignee: DONGNAN ELEVATOR CO., LTD., Jiangsu (CN)

( * ) Notice: Subject to any disclaimer, the term of this patent is extended or adjusted under 35 U.S.C. 154(b) by 135 days.

(21) Appl. No.: 14/434,012

(22) PCT Filed: Mar. 26, 2014

(86) PCT No.: PCT/CN2014/074079
§ 371 (c)(1),
(2) Date: Apr. 7, 2015

(87) PCT Pub. No.: WO2015/010480
PCT Pub. Date: Jan. 29, 2015

(65) Prior Publication Data

US 2015/0291391 A1 Oct. 15, 2015

(30) Foreign Application Priority Data

Jul. 23, 2013 (CN) ..... 2013 1 0311108

(51) Int. Cl.
*B66B 5/28* (2006.01)
*B66B 5/24* (2006.01)

(52) U.S. Cl.
CPC . *B66B 5/28* (2013.01); *B66B 5/24* (2013.01)

(58) Field of Classification Search
CPC ..... B66B 5/28; B66B 5/24
(Continued)

(56) References Cited

U.S. PATENT DOCUMENTS 986,378 A * 3/1911 Furlow ..... F16F 9/48 188/287
1,136,678 A * 4/1915 Jansson ..... B66B 5/028 187/275

(Continued)

FOREIGN PATENT DOCUMENTS

CN 2487716 Y 4/2002
CN 102602772 A 7/2012

(Continued)

OTHER PUBLICATIONS

International Search Report dated Jun. 11, 2014 from corresponding International Patent Application No. PCT/CN2014/074079; 4 pgs.

*Primary Examiner* — Michael Riegelman
(74) *Attorney, Agent, or Firm* — Maier & Maier, PLLC

(57) ABSTRACT

An elevator anti-fall buffer based on flexible guidance. The anti-fall buffer is used for connecting and fixing an end part of a braking steel rope of an elevator. The anti-fall buffer has an upper support plate and a lower support plate, wherein a pulley set is provided on the upper support plate and the lower support plate, and a hydraulic damping buffer is provided at two sides of the pulley set. The anti-fall buffer uses the energy consumption principle of a hydraulic damping hole, and while protecting the braking steel rope from the force of impact created thereon by the elevator, prevents the force of impact from a spring on the elevator post- (Continued)

braking, improving the safety and reliability of elevator braking, thereby improving safety of an elevator, while also using a pulley set can increase the braking distance of the braking steel rope, thereby lengthening life of the steel rope.

3 Claims, 6 Drawing Sheets

(58) Field of Classification Search
USPC ..... 187/347
See application file for complete search history.

(56) References Cited

U.S. PATENT DOCUMENTS 1,873,807 A * 8/1932 Arnold ..... B66B 5/282 187/343
2,744,587 A * 5/1956 Beck ..... B66B 5/282 187/344
3,889,934 A * 6/1975 Kamman ..... F16F 9/48 188/287
4,015,835 A * 4/1977 Schumacher ..... B66B 5/282 187/344
4,245,578 A * 1/1981 Bianco ..... B63B 27/36 114/312
4,635,907 A * 1/1987 Bialy ..... B66B 5/282 187/344
4,848,519 A * 7/1989 Ericson ..... B66B 9/04 187/272
2003/0217895 A1* 11/2003 Kigawa ..... B66B 5/282 187/344
2012/0132487 A1* 5/2012 Araki Yassuda ..... B66B 7/08 187/411
2013/0233654 A1* 9/2013 Cao ..... B66B 7/025 187/407
2014/0110194 A1 4/2014 Zhu et al.
2015/0122592 A1* 5/2015 Zhu ..... B66B 5/24 188/65.1

FOREIGN PATENT DOCUMENTS

CN 103359577 A 10/2013
CN 203345883 U 12/2013
DE 112011104744 T5 12/2013
JP 2003292262 A 10/2003
MY 141821 A 6/2010

* cited by examiner

SPECIFIC ELEVATOR ANTI-FALL BUFFER BASED ON FLEXIBLE GUIDANCE

FIELD OF THE INVENTION

The present invention relates to safety field of the lifting equipment, in particular to a special elevator anti-drop buffer based on flexible guide, which is especially suitable for use on mine elevators in deep shafts and special elevators in other fields based on flexible guide.

BACKGROUND OF THE INVENTION

Recently, as the elevator technology is developed rapidly, more and more special elevators are used in different working conditions. In lifting application in mine shafts, a flexible guide-based mine elevators are even more widely applied, owing to their simple structure, easy installation, high safety, and high controllability, etc. In terms of safety performance of the special elevators based on flexible guide, a speed limiter and a safety clamp are usually used in combination to implement overs-peed protection. When emergency braking, the safety clamp of the elevator instantaneously seizes the flexible brake steel wire rope under the linkage functions of the speed limiter, so as to realize braking. At the moment of braking, the brake steel wire rope suffers a huge impact owing to the high inertia of the entire elevator unit. Therefore, an anti-drop buffer must be connected to the upper end of the brake steel wire rope, so as to reduce the impact on the steel wire rope, protect the steel wire rope and prolong the service life of the steel wire rope.

An existing anti-drop buffer is mainly consisted of a spring and a guide sleeve, and it provides buffer protection for the steel wire rope by means of the buffer action of the spring in the anti-drop protection process. However, in the anti-drop buffering process, the gravitational potential energy of the elevator is converted into the elastic potential energy of the spring owing to the contraction of the spring, and, at the end of the braking, the spring will release the potential energy and drives the elevator to backstroke, which severely increases the safety risk to the persons and materials transported in the elevator.

SUMMARY OF THE INVENTION

Object of the Invention

To overcome the drawback in the prior art, the present invention provides a safe and reliable special elevator anti-drop buffer based on flexible guide.

To solve the technical problem described above, the present invention employs the following technical schemes:

A special elevator anti-drop buffer based on flexible guide, which is used for connecting and fixing the upper end of a brake steel wire rope of an elevator, and comprises an upper support plate, a pulley block, a hydraulic damping buffer, a rope end assembly, and a lower support plate;

The lower support plate is fixed to a top shaft platform in the shaft, and the upper support plate is arranged above the lower support plate, the pulley block is arranged on the upper support plate and lower support plate, and the upper end of the brake steel wire rope runs over the respective pulleys of the pulley block and is fixed by the rope end assembly;

The hydraulic damping buffer is arranged between the upper support plate and the lower support plate, and comprises an inner hydraulic cylinder and an outer hydraulic cylinder that are muff-coupling, the upper end of the inner hydraulic cylinder is fixed to the upper support plate, while the upper end of the outer hydraulic cylinder is provided with a ferrule, and the lower end of the outer hydraulic cylinder is fixed to a base, which is fixed to the lower support plate, an inner hydraulic cylinder piston is arranged in the cavity of the inner hydraulic cylinder, and a spring is arranged between the inner hydraulic cylinder piston and the upper end of the cavity of the inner hydraulic cylinder, an outer hydraulic cylinder piston is arranged in the cavity of the outer hydraulic cylinder, and the outer hydraulic cylinder piston is fixed to the lower end of the inner hydraulic cylinder, an annular sleeve with damping holes runs through the center of the outer hydraulic cylinder piston, and the lower end of the annular sleeve with damping holes is fixed to the base; a first enclosed space is formed among the outer hydraulic cylinder, the outer hydraulic cylinder piston and the annular sleeve with damping holes, and a second enclosed space is formed among the inner hydraulic cylinder, the inner hydraulic cylinder piston and the annular sleeve with damping holes, the first enclosed space and the second enclosed space communicate with each other via the damping holes on the annular sleeve with damping holes, and hydraulic oil is filled in the first enclosed space and the second enclosed space.

Furthermore, in the present invention, the pulley block comprises one lower deflecting pulley arranged on the lower support plate and two upper deflecting pulleys arranged on the upper support plate, and located at the two sides of the lower deflecting pulley respectively; a through-hole for the brake steel wire rope to pass through is arranged in the lower support plate at one side of the lower deflecting pulley, and the rope end assembly is arranged on the lower support plate at the other side of the lower deflecting pulley.

Furthermore, in the present invention, one end of the rope end assembly is connected and fixed to the lower support plate via a threaded stud with a spring, the other end of the rope end assembly is provided with a rolling pulley, and the upper end of the brake steel wire rope is fixed to the rolling pulley via a rope clamp.

Beneficial Effects

The anti-drop buffer adopts the energy consumption principle of hydraulic damping holes, the brake steel wire rope is protected from being impacted by the elevator, meanwhile, the impact caused by a spring on the elevator after braking is prevented, and the safety and reliability performance of the elevator braking can be improved, so the safety performance of a special elevator is effectively improved. In addition, with the pulley block utilized in the special elevator anti-drop buffer, the braking length of the brake steel wire rope can be increased, so the service life of the steel wire rope can be prolonged.

Among the figures: 1—upper support plate, 2—pulley block, 3—hydraulic damping buffer, 4—steel wire rope, 5—rope end assembly, 6—lower support plate, 7—anti-drop buffer, 8—shaft top platform, 9—shaftway, 10—elevator, 11—progressive-type safety clamp, 12—steel wire rope tensioner, 3-1—inner hydraulic cylinder, 3-2—spring, 3-3—ferrule, 3-4—inner hydraulic cylinder piston, 3-5—outer hydraulic cylinder, 3-6—outer hydraulic cylinder piston, 3-7—sleeve with damping holes, 3-8—hydraulic oil, 3-9—base, 3-10—first enclosed space, 3-11—second enclosed space.

DETAILED DESCRIPTION OF THE EMBODIMENTS

Hereunder the present invention will be further detailed with reference to the accompanying drawings.

Figure 1:
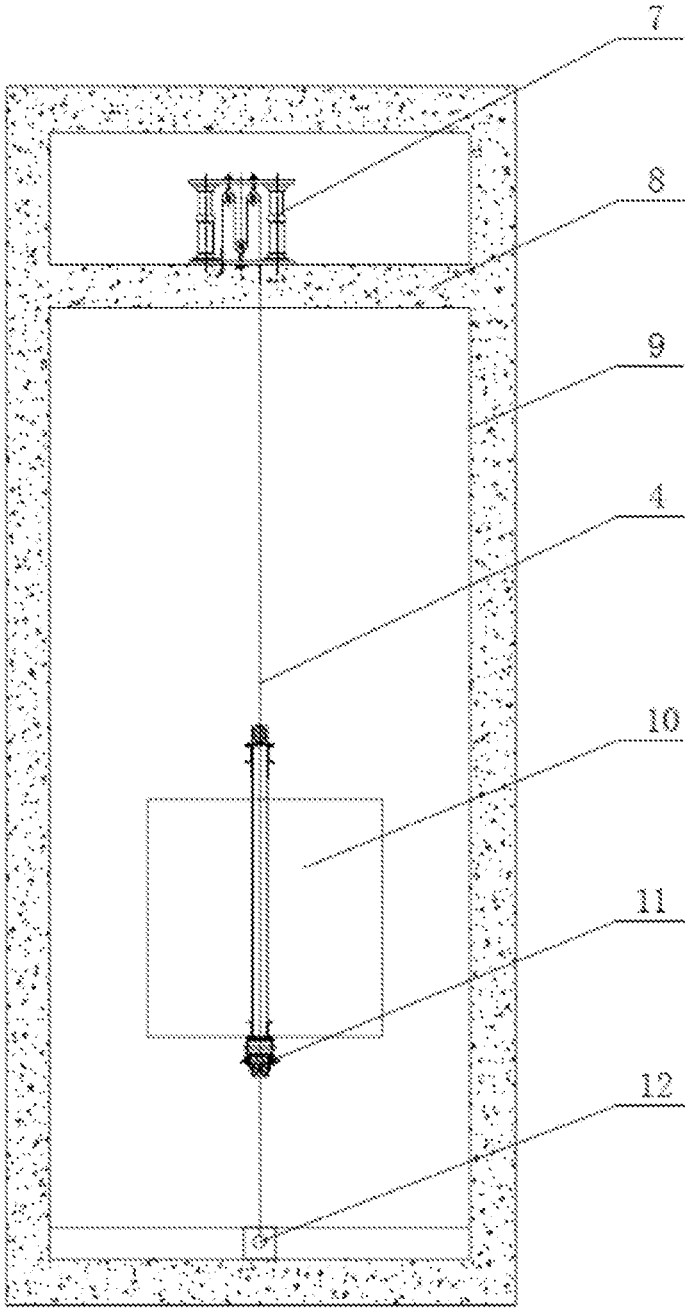
FIG. 1 is a front view of the position of the special elevator anti-drop buffer based on flexible guide in an elevator anti-drop system according to the present invention.
Figure 2:
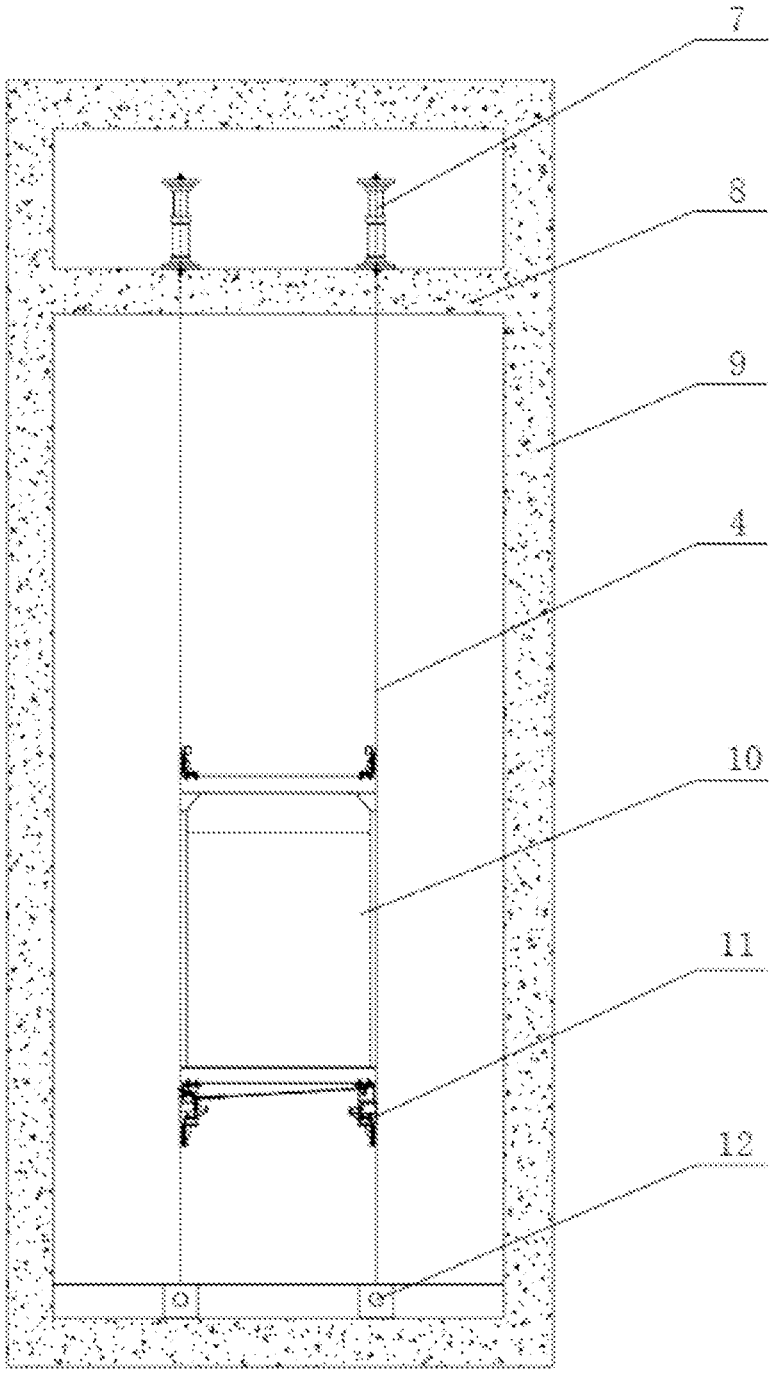
FIG. 2 is a side view of the position of the special elevator anti-drop buffer based on flexible guide in an elevator anti-drop system according to the present invention.
Figure 3:
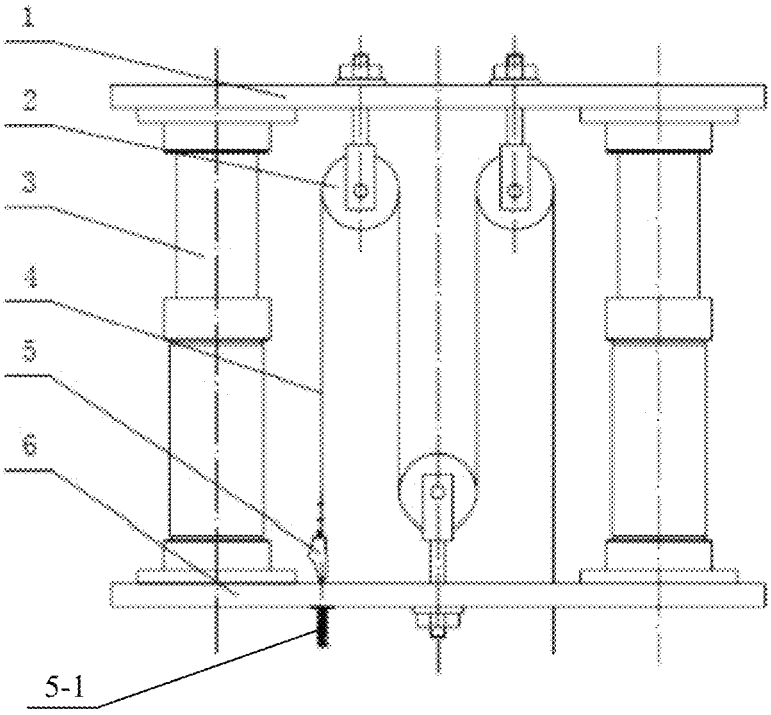
FIG. 3 is a front view of the special elevator anti-drop buffer based on flexible guide according to the present invention.
Figure 4:
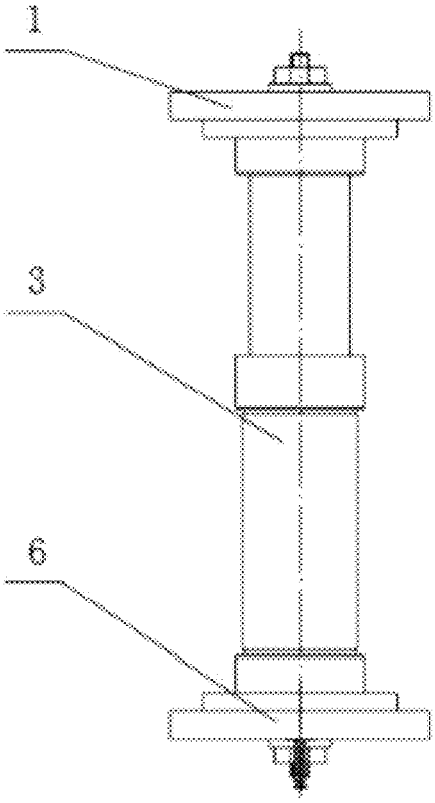
FIG. 4 is a side view of the special elevator anti-drop buffer based on flexible guide according to the present invention.
Figure 5:
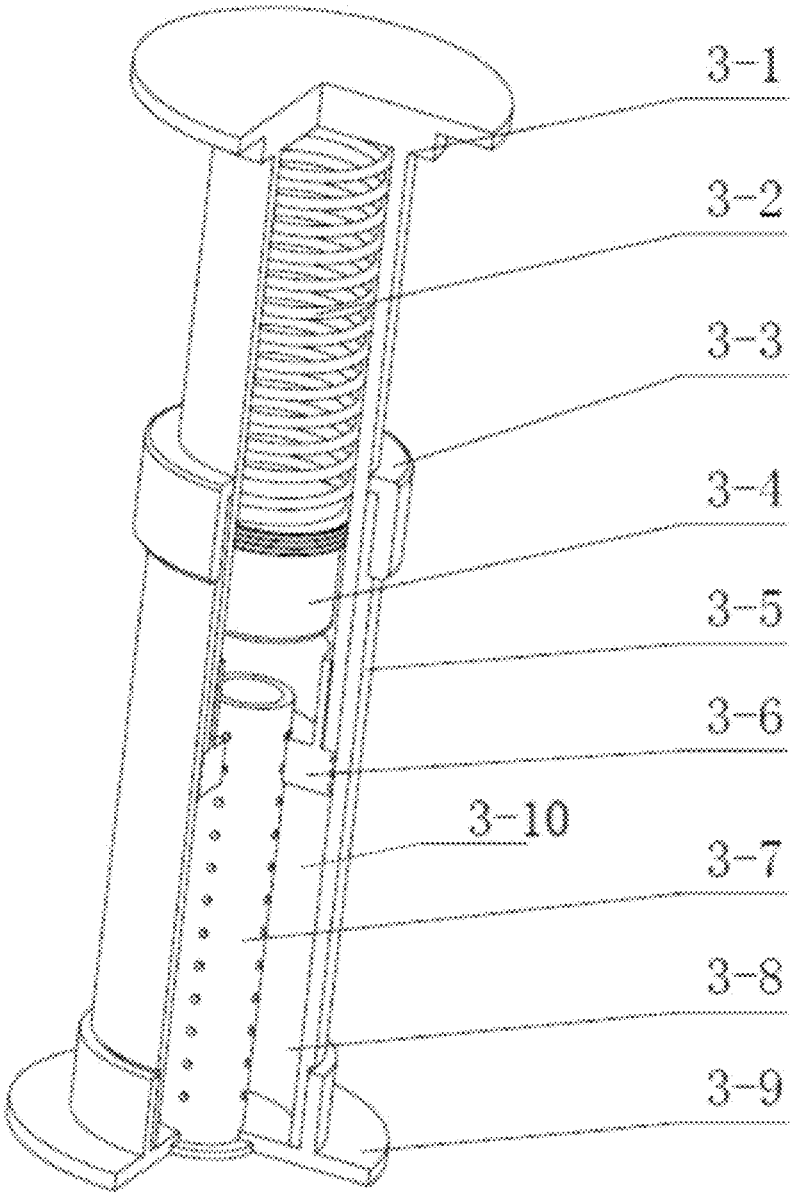
FIG. 5 is a 3D view of the hydraulic damping buffer according to the present invention.
Figure 6:
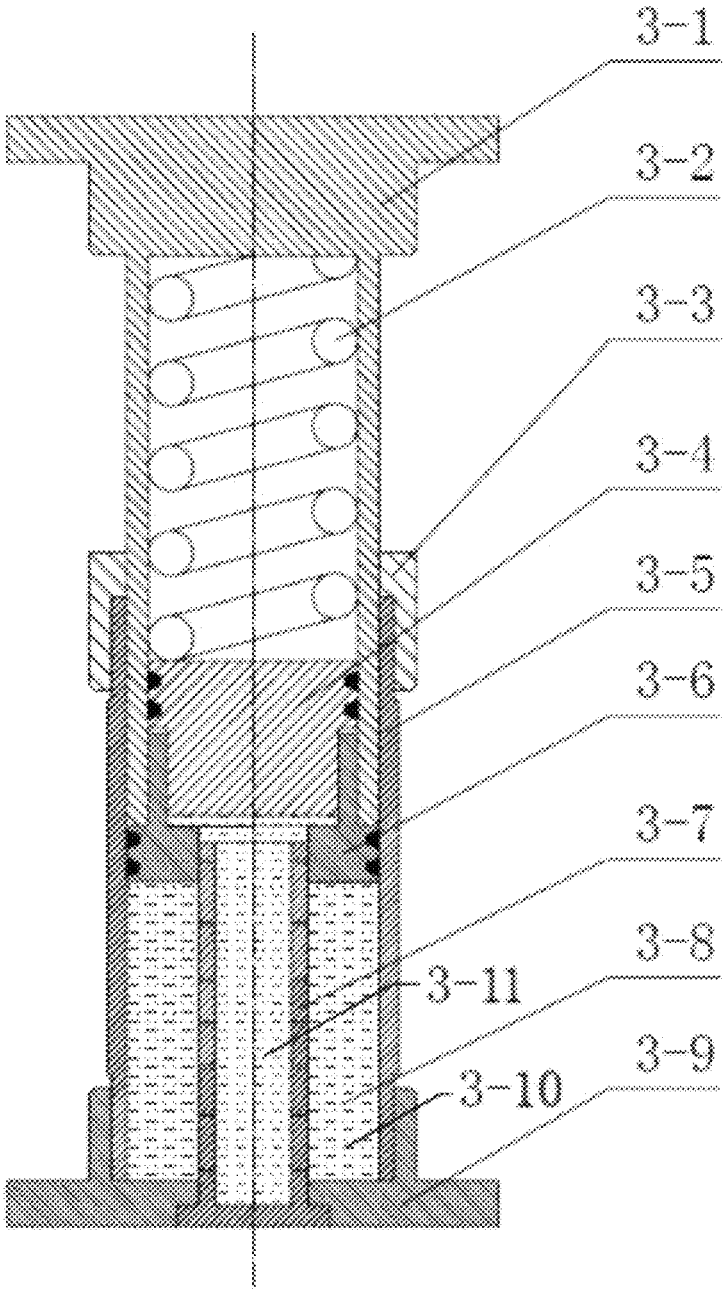
FIG. 6 is a sectional view of the hydraulic damping buffer in uncompressed state according to the present invention.
Figure 7:
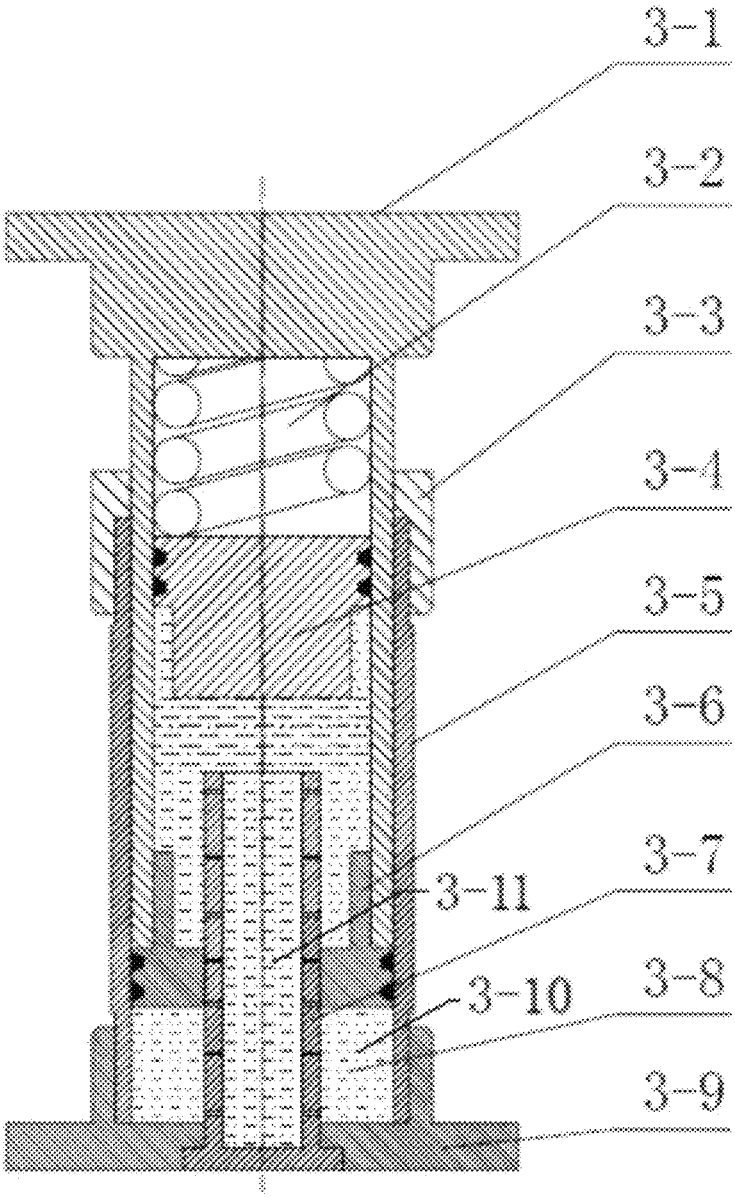
FIG. 7 is a sectional view of the hydraulic damping buffer in compressed state according to the present invention.

As shown in FIG. 1 and FIG. 2, an elevator anti-drop system mainly comprises brake steel wire ropes 4 which arranged at the two sides of an elevator 10, wherein, the lower end of the brake steel wire rope 4 is fixed by a steel wire rope tensioner 12, and a progressive-type safety clamp 11 that can seize the brake steel wire rope 4 is arranged on the lower end of the elevator 10. The special elevator anti-drop buffer based on flexible guide in the present invention is designed to connect and fix the upper end of the brake steel wire rope 4.

As shown in FIGS. 3-7, the anti-drop buffer 7 according to the present invention comprises an upper support plate 1, a pulley block 2, a hydraulic damping buffer 3, a rope end assembly 5, and a lower support plate 6.

The lower support plate 6 is fixed to a shaft top platform 8 in the shaftway 9, and the upper support plate 1 is arranged above the lower support plate 6. The pulley block 2 comprises one lower deflecting pulley arranged on the lower support plate 6 and two upper deflecting pulleys arranged on the upper support plate 1 at the two sides of the lower deflecting pulley. A through-hole for the brake steel wire rope 4 to pass through is arranged in the lower support plate 6 at one side of the lower deflecting pulley, and the rope end assembly 5 is arranged on the lower support plate 6 at the other side of the lower deflecting pulley. One end of the rope end assembly 5 is connected and fixed to the lower support plate 6 via a threaded stud with a spring, the other end of the rope end assembly 5 is provided with a rolling pulley, and the upper end of the brake steel wire rope 4 runs over the respective pulleys of the pulley block 2 and then is fixed to the rolling pulley via a rope clamp.

The hydraulic damping buffer 3 is arranged between the upper support plate 1 and the lower support plate 6. The hydraulic damping buffer 3 comprises an inner hydraulic cylinder 3-1 and an outer hydraulic cylinder 3-5 that are muff-coupling, the upper end of the inner hydraulic cylinder 3-1 is fixed to the upper support plate 1, the upper end of the outer hydraulic cylinder 3-5 is provided with a ferrule 3-3, to protect the upper end of the outer hydraulic cylinder 3-5 against potential deformation under the action of the inner hydraulic cylinder 3-1. The lower end of the outer hydraulic cylinder 3-5 is fixed to a base 3-9, and the base 3-9 is fixed to the lower support plate 6. An inner hydraulic cylinder piston 3-4 is arranged in the cavity of the inner hydraulic cylinder 3-1, and a spring 3-2 is arranged between the inner hydraulic cylinder piston 3-4 and the upper end of the cavity of the inner hydraulic cylinder 3-1. An outer hydraulic cylinder piston 3-6 is arranged in the cavity of the outer hydraulic cylinder 3-5, and the outer hydraulic cylinder piston 3-6 is fixed to the lower end of the inner hydraulic cylinder 3-1, a annular sleeve with damping holes 3-7 runs through the center of the outer hydraulic cylinder piston 3-6, and the lower end of the annular sleeve with damping holes 3-7 is fixed to the base 3-9. A first enclosed space is formed among the outer hydraulic cylinder 3-5, the outer hydraulic cylinder piston 3-6 and the annular sleeve with damping holes 3-7, a second enclosed space is formed among the inner hydraulic cylinder 3-1, the inner hydraulic cylinder piston 3-4, and the annular sleeve with damping holes 3-7, and the first enclosed space and the second enclosed space communicate with each other via the damping holes on the annular sleeve with damping holes 3-7, and the first enclosed space and the second enclosed space are filled with hydraulic oil (3-8).

The working principle of the anti-drop buffer 7 according to the present invention is as follows.

In case of an accident of the elevator 10, the progressive-type safety clamp 11 will seize the brake steel wire rope 4 owing to the linkage functions of the speed limiter, and the progressive-type safety clamp 11 will produce huge inertial shock force on the brake steel wire rope 4 owing to the inertial effect of the elevator 10. The brake steel wire rope 4 transfers the inertial shock force from the elevator 10 to the upper support plate 1 via the pulley block 2, and the upper support plate 1 presses the inner hydraulic cylinder 3-1 to move downwards. The inner hydraulic cylinder 3-1 squeezes a part of the hydraulic oil 3-8 in the first enclosed space into the second enclosed space by the outer hydraulic cylinder piston 3-6 through the damping holes in the annular sleeve with damping holes 3-7, and the hydraulic oil 3-8 in the second enclosed space is squeezed towards the inner hydraulic cylinder piston 3-4; consequently, the spring 3-2 is compressed. As the damping hole exerts a frictional damping effect on the hydraulic oil 3-8 and the spring 3-2 is compressed further in the process that the inner hydraulic cylinder 3-1 moves downwards, the inertial impact energy of the elevator 10 is converted to the heat energy resulted from the friction between the damping holes and the hydraulic oil 3-8 and the elastic potential energy of the spring 3-2; thus, buffer protection for the brake steel wire rope 4 is realized. In addition, in the braking process of the elevator 10, the braking length of the brake steel wire rope 4 is increased to be 4 times of the maximum descending length of the supporting plate 1 by the pulley block 2. Thus, by increasing the braking length of the brake steel wire rope 4, the service life of the steel wire rope 4 can be prolonged effectively.

After the elevator is braked, the total load on the spring 3-2 of the anti-drop buffer 7 is the gravity of the elevator, and the process is as follows: when the elevator is braked, the velocity of the elevator is decreased, the spring 3-2 contracts, and the kinetic energy of the elevator is gradually converted into the heat energy of the hydraulic oil 3-8 and the potential energy of the spring 3-2. In that process, the pressure borne on the spring 3-2 is increased gradually; when the force applied on the spring 3-2 is equal to the gravity of the elevator, the kinetic energy of the elevator has be completely converted into the heat energy of the hydraulic oil 3-8 and the potential energy of the spring 3-2, and thereby the elevator will stop. At this point, though the spring 3-2 still have stored energy, it will not have return motion owing to the balancing effect of the elevator and the damping effect of the hydraulic oil 3-8. Thus, severe back-stroke of the elevator can be avoided.

While the present invention has been illustrated and described with reference to some preferred embodiments, the present invention is not limited to these. Those skilled in the art should recognize that various variations and modifications can be made without departing from the spirit and scope of the present invention. All of such variations and modifications shall be deemed as falling into the protected scope of the present invention.

The invention claimed is:

1. A special elevator anti-drop buffer based on flexible guide, the anti-drop buffer is used for connecting and fixing an upper end of a brake steel wire rope of an elevator, wherein, the anti-drop buffer comprises an upper support plate, a pulley block comprising a plurality of pulleys, a hydraulic damping buffer, a rope end assembly, and a lower support plate;

the lower support plate is fixed to a shaft top platform in a shaftway, the upper support plate is arranged above the lower support plate, the pulleys of the pulley block are arranged on the upper support plate and lower support plate, and the upper end of the brake steel wire rope runs over the respective pulleys of the pulley block and is fixed to the rope end assembly;

the hydraulic damping buffer is arranged between the upper support plate and the lower support plate, and comprises an inner hydraulic cylinder and an outer hydraulic cylinder that is concentrically disposed around and coupled to the inner hydraulic cylinder, an upper end of the inner hydraulic cylinder is fixed to the upper support plate, an upper end of the outer hydraulic cylinder is provided with a ferrule, a lower end of the outer hydraulic cylinder is fixed to a base, the base is fixed to the lower support plate, an inner hydraulic cylinder piston is arranged in a cavity of the inner hydraulic cylinder, a spring is arranged between the inner hydraulic cylinder piston and an upper end of the cavity of the inner hydraulic cylinder, an outer hydraulic cylinder piston is arranged in a cavity of the outer hydraulic cylinder, and the outer hydraulic cylinder piston is fixed to the lower end of the inner hydraulic cylinder, an annular sleeve with damping holes runs through a center of the outer hydraulic cylinder piston, and a lower end of the annular sleeve with damping holes is fixed to the base; a first enclosed space is formed between the base and the outer hydraulic cylinder piston and adjacent to an inner circumference of the outer hydraulic cylinder, a second enclosed space is formed by the inner hydraulic cylinder, the inner hydraulic cylinder piston and the annular sleeve with damping holes, the first enclosed space and the second enclosed space communicate with each other via the damping holes on the annular sleeve with damping holes, and the first enclosed space and the second enclosed space are filled with hydraulic oil.

2. The special elevator anti-drop buffer based on flexible guide according to claim 1, wherein, the pulley block comprises one lower deflecting pulley arranged on the lower support plate and two upper deflecting pulleys arranged on the upper support plate, respectively on a first side and a second side of the lower deflecting pulley; a through-hole for the brake steel wire rope to pass through is arranged in the lower support plate on the first side of the lower deflecting pulley, and the rope end assembly is arranged on the lower support plate on the second side of the lower deflecting pulley.

3. The special elevator anti-drop buffer based on flexible guide according to claim 1, wherein, a first end of the rope end assembly is connected and fixed to the lower support plate via a threaded stud with a spring, a second end of the rope end assembly is provided with one of the plurality of pulleys, and a lower end of the brake steel wire rope is fixed by a steel wire rope tensioner.

* * * * *